US006962253B1

(12) United States Patent
McZeek

(10) Patent No.: US 6,962,253 B1
(45) Date of Patent: Nov. 8, 2005

(54) POCKETSIZE PAPER MONEY BANK DEVICE

(76) Inventor: Vincent McZeek, 3833 River Pl., Mobile, AL (US) 36605

( * ) Notice: Subject to any disclaimer, the term of this patent is extended or adjusted under 35 U.S.C. 154(b) by 231 days.

(21) Appl. No.: 10/628,120

(22) Filed: Jul. 28, 2003

(51) Int. Cl.[7] ..... A45C 11/00; A45C 13/10; B65D 55/14

(52) U.S. Cl. ..... 206/37; 206/1.5; 70/63

(58) Field of Search ..... 206/37, 38, 39, 206/1.5, 0.8, 449; 232/1 D, 4 R, 43.1, 43.3; 150/132–134, 150/143, 147, 149, 150–152; 312/183; 70/63

(56) References Cited

U.S. PATENT DOCUMENTS 731,480 A * 6/1903 MacDonald ..... 206/39
901,409 A * 10/1908 Woolums ..... 70/63
928,483 A * 7/1909 Wakerman ..... 292/144
3,927,792 A * 12/1975 Andrade et al. ..... 206/1.5
4,202,445 A * 5/1980 Porter ..... 206/37
4,219,116 A * 8/1980 Borkan ..... 206/1.5
5,918,554 A * 7/1999 Rassamni ..... 70/63
6,450,400 B1 * 9/2002 Savoir, Jr. ..... 232/1 D
6,490,893 B1 * 12/2002 Benion ..... 70/63

* cited by examiner

*Primary Examiner*—Mickey Yu
*Assistant Examiner*—J. Gregory Pickett

(57) ABSTRACT

A pocketsize paper money bank device for storing and safeguarding dollar bills. The pocketsize paper money bank device includes a thin rectangular-shaped container having top, bottom, back and end walls, and also having an open front; and also includes a door being hingedly attached to the thin rectangular-shaped container and being closable and lockable over the open front of the thin rectangular-shaped container; and further includes a bill feeder assembly being disposed in the thin rectangular-shaped container.

4 Claims, 4 Drawing Sheets

POCKETSIZE PAPER MONEY BANK DEVICE

BACKGROUND OF THE INVENTION

1. Field of the Invention

The present invention relates to paper money banks and more particularly pertains to a new pocketsize paper money bank device for storing and safeguarding dollar bills.

2. Description of the Prior Art

The use of paper money banks is known in the prior art. More specifically, paper money banks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,244,023; U.S. Pat. No. 4,202,445; U.S. Pat. No. 4,716,948; U.S. Pat. No. 5,205,481; U.S. Pat. No. 1,732,452; and U.S. Pat. No. Des. 404,567.

While these devices fulfill their respective, particular objectives and requirements, the aforementioned patents do not disclose a new pocketsize paper money bank device. The prior art includes containers having slidable drawers for keeping paper money.

SUMMARY OF THE INVENTION

The general purpose of the present invention, which will be described subsequently in greater detail, is to provide a new pocketsize paper money bank device which has many of the advantages of the paper money banks mentioned heretofore and many novel features that result in a new pocketsize paper money bank device which is not anticipated, rendered obvious, suggested, or even implied by any of the prior art paper money banks, either alone or in any combination thereof. The present invention includes a thin rectangular-shaped container having top, bottom, back and end walls, and also having an open front; and also includes a door being hingedly attached to the thin rectangular-shaped container and being closable and lockable over the open front of the thin rectangular-shaped container; and further includes a bill feeder assembly being disposed in the thin rectangular-shaped container. None of the prior art includes the combination of the elements of the present invention.

There has thus been outlined, rather broadly, the more important features of the pocketsize paper money bank device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new pocketsize paper money bank device which has many of the advantages of the paper money banks mentioned heretofore and many novel features that result in a new pocketsize paper money bank device which is not anticipated, rendered obvious, suggested, or even implied by any of the prior art paper money banks, either alone or in any combination thereof.

Still another object of the present invention is to provide a new pocketsize paper money bank device for storing and safeguarding dollar bills.

Still yet another object of the present invention is to provide a new pocketsize paper money bank device that is easy and convenient to use.

Even still another object of the present invention is to provide a new pocketsize paper money bank device that prevents accidental loss of dollar bills won at casinos, in particular, and also prevents theft by pick-pocketing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
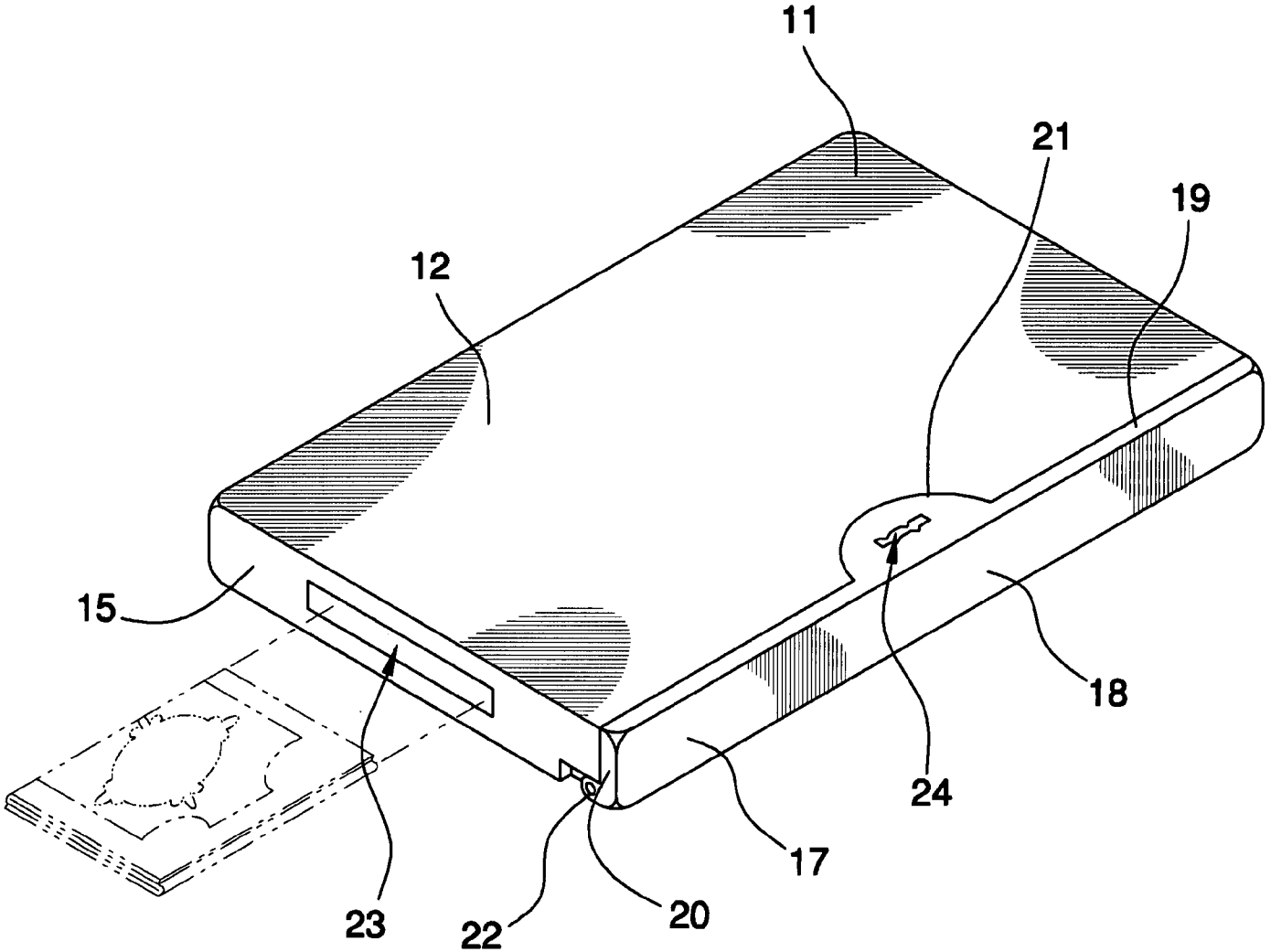
FIG. 1 is a perspective view of a new pocketsize paper money bank device according to the present invention.
Figure 2:
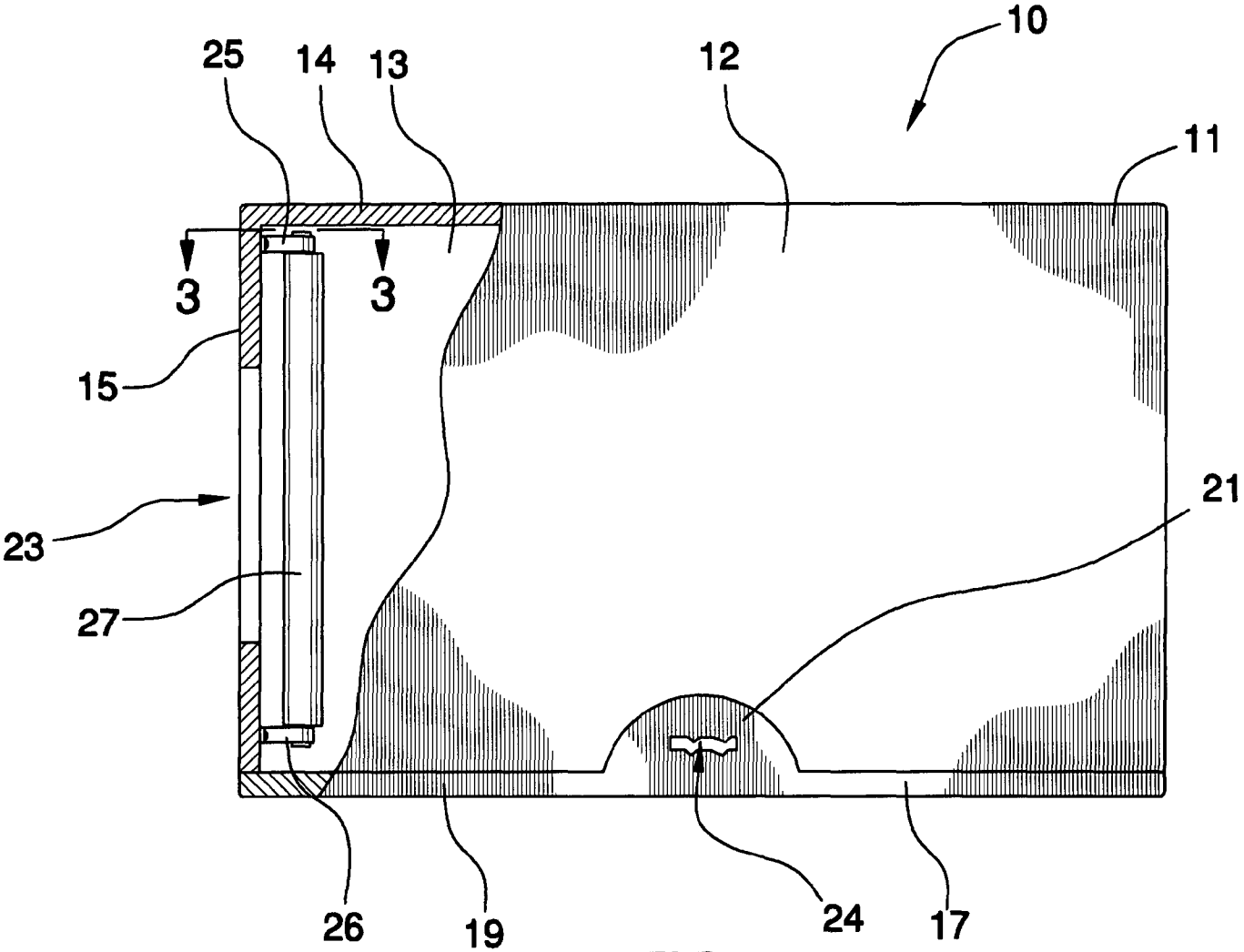
FIG. 2 is a partial cutaway top plan view of the present invention.
Figure 3:
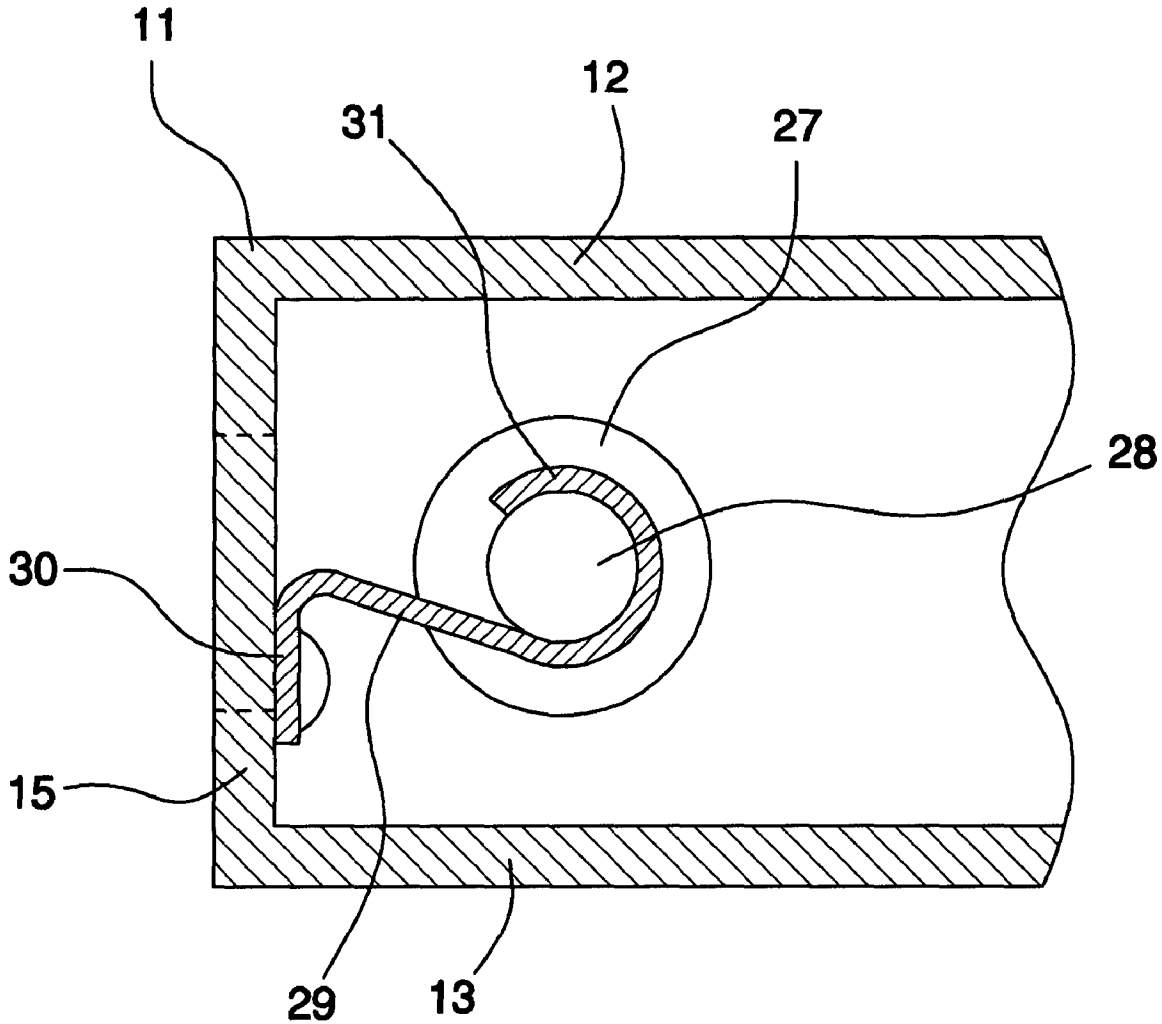
FIG. 3 is a detailed side elevational view of the spring of the present invention.
Figure 4:
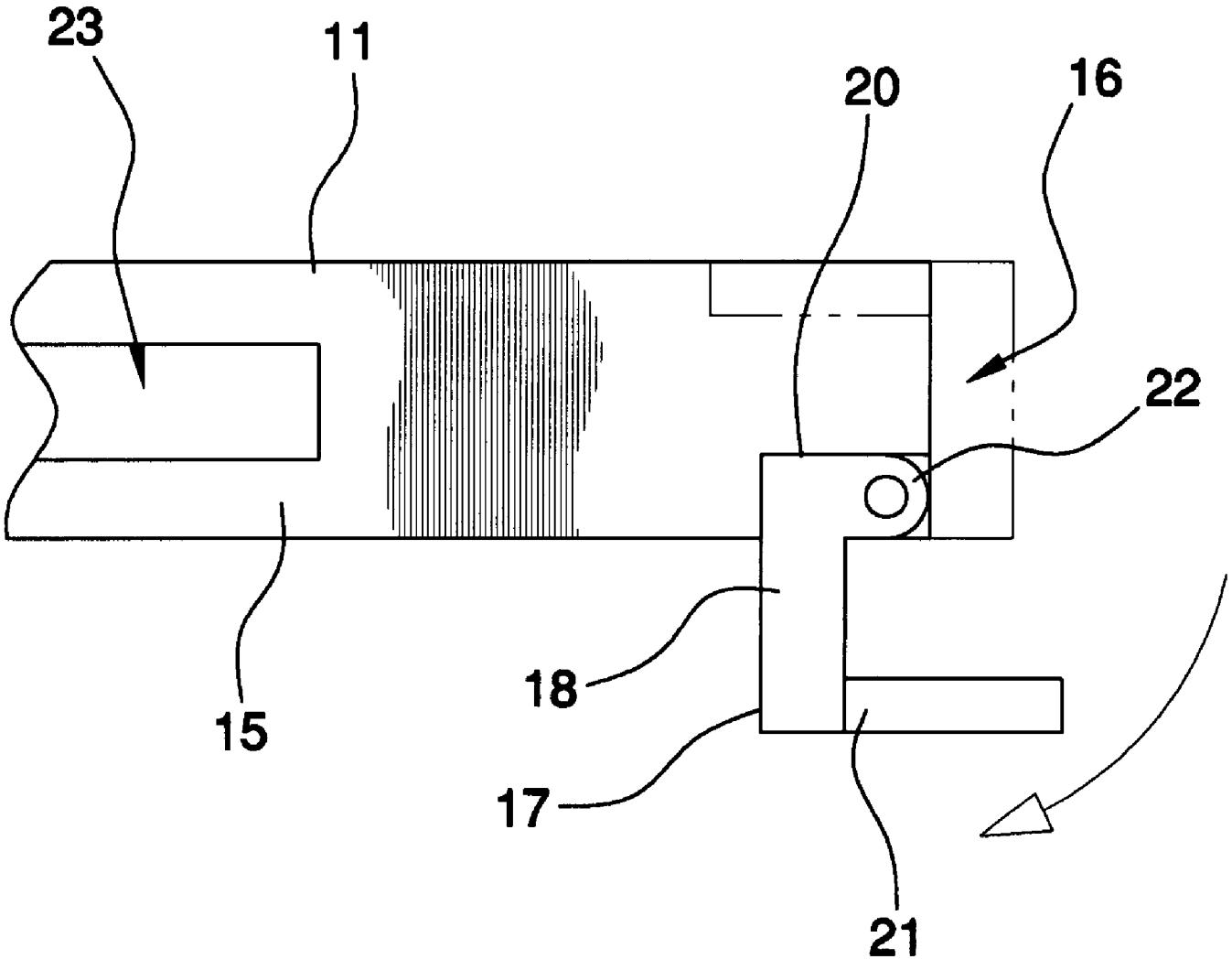
FIG. 4 is a partial side elevational view of the present invention.

With reference now to the drawings, and in particular to FIGS. 1 through 4 thereof, a new pocketsize paper money bank device embodying the principles and concepts of the present invention and generally designated by the reference numeral 10 will be described.

As best illustrated in FIGS. 1 through 4, the pocketsize paper money bank device 10 generally comprises a thin rectangular-shaped container 11 having top, bottom, back and end walls 12–15, and also having an open front 16. The thin rectangular-shaped container 11 also includes a bill-receiving slot 23 being disposed through one of the end walls 15 and being adapted for receiving paper money therethrough into the thin rectangular-shaped container 11.

A door 17 is hingedly attached to the thin rectangular-shaped container 11 and is closable and conventionally lockable over the open front 16 of the thin rectangular-shaped container 11. The door 17 includes a main wall 18, and also includes side and end perimeter walls 19,20 being angled relative to the main wall 18, and further includes a tab 21 being integrally attached to one of the side perimeter walls 19 and having a key slot 24 being disposed therethrough for receiving a key to conventionally lock and unlock the door 17 to the thin rectangular-shaped container 11, and also include eyelets 22 being integrally attached to the end perimeter walls 20 for hingedly attaching the door 17 to the thin rectangular-shaped container 11. The tab 21 is removably disposed upon the top wall 12 of the thin rectangular-shaped container 11 for locking the door 17 to the thin rectangular-shaped container 11.

A bill feeder assembly is disposed in the thin rectangular-shaped container 11. The bill feeder assembly includes bracket members 25,26 being conventionally attached to an inner side of one of the end walls 15 adjacent to the bill-receiving slot 23 of the thin rectangular-shaped container 11, and also includes an elongate roller 27 having an axle 28 which is journaled in the bracket members 25,26, and further includes a spring 29 being engaged to the elongate roller 27 for rotating the elongate roller 27 to facilitate the insertion of paper money into the thin rectangular-shaped container 11. The spring 29 has an end portion 30 which is fastened to the inner side of one of the end walls 15 of the thin rectangular-shaped container 11, and also has a hook-shaped portion 31 which is angled relative to the end portion 30 and which is engaged about a portion of the axle 28 of the elongate roller 27.

In use, the user locks the door 17 over the open front 16 of the thin rectangular-shaped container 11 using a conventional key, and extends folded dollar bills through the bill-receiving slot 23 and into the thin rectangular-shaped container 11 with the elongate roller 27 facilitating entry of the folded dollar bills into the thin rectangular-shaped container 11. The user can unlock the door 17 and retrieve the stored dollar bills through the open front 16 of the thin rectangular-shaped container 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the pocketsize paper money bank device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pocketsize paper money bank device comprising:

a thin rectangular-shaped container having top, bottom, back and end walls, and also having an open front, said thin rectangular-shaped container also including a bill-receiving slot being disposed through one of said end walls and being adapted fox receiving paper money therethrough;

a door being hingedly attached to said thin rectangular-shaped container and being closable and lockable over said open front of said thin rectangular-shaped container, said door including a main wall, and also includes side and end perimeter walls being angled relative to said main wall, and further including a tab being attached to one of said side perimeter walls and having a key slot being disposed therethrough for receiving a key to lock and unlock said door to said thin rectangular-shaped container, and also including eyelets being attached to said end perimeter walls for hingedly attaching said door to said thin rectangular-shaped container; and a bill feeder assembly being disposed in said thin rectangular-shaped container to facilitate the insertion of paper money into said thin rectangular-shaped container.

2. The pocketsize paper money bank device as described in claim 1, wherein said tab is removably disposed upon said top wall of said thin rectangular-shaped container for locking said door to said thin rectangular-shaped container.

3. The pocketsize paper money bank device as described in claim 2, wherein said bill feeder assembly includes bracket members being attached to an inner side of said one of said end walls adjacent to said bill-receiving slot of said thin rectangular-shaped container, and also includes an elongate roller having an axle which is journaled in said bracket members, and further includes a spring being engaged to said elongate roller for rotating said elongate roller to facilitate the insertion of paper money into said thin rectangular-shaped container.

4. The pocketsize paper money bank device as described in claim 3, wherein said spring has an end portion which is fastened to the inner side of said one of said end walls of said thin rectangular-shaped container, and also has a hook-shaped portion which is angled relative to said end portion and which is engaged about a portion of said axle of said elongate roller.

* * * * *